United States Patent [19]

Bourbon

[11] 4,256,450

[45] Mar. 17, 1981

[54] LIQUID FUEL BURNER

[75] Inventor: Raymond Bourbon, Caluire, France

[73] Assignee: Centre Technique Industriel dit "Centre Technique des Industries Aerauliques et Thermiques", Orsay, France

[21] Appl. No.: 962,740

[22] Filed: Nov. 21, 1978

[30] Foreign Application Priority Data

Nov. 25, 1977 [FR] France ..... 77 36455

[51] Int. Cl.[3] ..... F23D 5/02

[52] U.S. Cl. ..... 431/337; 431/182; 431/190

[58] Field of Search ..... 431/173, 182, 185, 190, 431/238, 239, 335, 336, 337

[56] References Cited

U.S. PATENT DOCUMENTS

| | | | |
|---|---|---|---|
| 1,569,967 | 1/1926 | Danielson | 431/336 |
| 2,200,861 | 5/1940 | Peoples | 431/336 |
| 2,594,062 | 4/1952 | Norman | 431/336 |
| 4,173,450 | 11/1979 | Schrank | 431/190 |

FOREIGN PATENT DOCUMENTS

| | | |
|---|---|---|
| 710045 | 5/1931 | France . |
| 1073955 | 3/1954 | France . |
| 1114033 | 12/1955 | France . |
| 1520676 | 3/1968 | France . |
| 271768 | 7/1964 | Netherlands . |

*Primary Examiner*—Robert S. Ward, Jr.

[57] ABSTRACT

A liquid fuel burner has a combustion head connected to a vaporization chamber which is fed with air atomized fuel by an atomizer so that the fuel is initially atomized, in a converging tube, and then vaporized prior to mixing with air and combustion.

8 Claims, 6 Drawing Figures

LIQUID FUEL BURNER

This invention relates to a burner for heat generation using liquid fuel. Burners of the invention are primarily intended for relatively low power heating installations, for instance, for individual dwellings, that is to say heating installations having an output of up to about twenty thermies per hour (about 84 MJ/hr).

Liquid fuel burners are intended to mix the fuel, as liquid or gas, with air and then to ensure combustion of the mixture so as to produce energy which is capable of heating a heat-transfer fluid such as water or air. The fuel can, initially, either be treated by atomisation or vaporisation.

Atomisation consists of breaking up the fuel into very fine particles in order to assist the formation of vapours and the mixing thereof with air, and is most commonly performed by a mechanical process, in which the fuel when under pressure is passed through grooves and orifices of small dimensions. For low heat outputs, such as those in the range mentioned, the precision of the machinings is insufficient to guarantee the output and to ensure a homogeneous distribution of the fuel in the atomised jet and hence in the combustion air. In addition, the small dimensions of the grooves and orifices render these very susceptible to clogging. Other atomisation processes involve compressors, which are expensive and noisy or the use of a rotating dish, the mechanism of which is also complex, expensive and frequently noisy, or ultrasonic means the reliability of which is far from certain, or there is electrostatic atomisation, in which cases, however, it has scarcely been possible suitably to separate the combustion zone from the electrical filed for atomisation.

Vaporisation, the alternative fuel treatment, is common in domestic heating, but the efficiency is low, the combustion can easily deteriorate depending on the draught and, in particular, automatisation remains very difficult.

Relative to the above discussion, French Pat. No. 1,073,955 relates to coarse atomisation employing a compressor and French Pat. No. 1,114,033 to coarse atomisation using a venturi tube (which is somewhat unsatisfactory as the droplets tend to recombine in the convergent part) while French Pat. No. 710,045 teaches the imparting of a vortical motion to heavy oils to improve combustion.

This invention reflects a new approach to the combustion of liquid fuels such as domestic fuel oil or of a similar product such as kerosene, in which prior to vaporisation, the fuel is coarsely atomised by means of air at a very low pressure of the order to three millibars.

According to the present invention there is provided a burner for use with liquid fuel including a combustion head, means to feed combustion air under pressure through a pipe to the combustion head, a vaporisation chamber connected to the combustion head to provide vaporised fuel to the combustion head, and means for feeding liquid fuel in the form of droplets to the vaporisation chamber, said fuel feeding means including a converging tube terminating in the wall of the vaporisation chamber, means for feeding liquid fuel at essentially atmospheric pressure to the tube and means for feeding a vortical stream of air for atomisation to the level of the neck of the converging tube.

The apparatus of this invention can operate at least as well as known apparatus. However, it can be more readily automated, while there is no need to employ compressors or other complex and delicate items.

In practice, the coarse atomisation using air is carried out at the level of the neck of the converging tube where the liquid fuel, which is at essentially atmospheric pressure, is brought into contact with a vortical stream of air. It has been found that only a converging tube makes it possible to obtain the desired result, because if a Venturi tube were used, then instead of atomising in the form of droplets or particles and increasing the velocity of these particles, the walls of the divergent part of the Venturi tube would be wetted and an undispersed liquid film would be re-formed.

The neck of this converging tube is advantageously located on a generatrix of the vaporisation chamber.

The burner can have a go/no go output regulator or an output regulator with several settings, and can be very simple to operate and offers good combustion, and is capable of being automated and miniaturised and is suitable for fitting both to central heating boilers having a furnace at below or slightly above atmospheric pressure, and to hot-air generators, and which is also suitable for replacing the combustion chambers in vaporisation-type oil stoves.

In an advantageous embodiment, the means for feeding fuel and a vortex of air, which form the atomiser, consist of a cylindrical chamber terminated by the converging tube, the fuel injector and its feed pipe being located in the longitudinal axis of this chamber, and the means for feeding a vortex of air opens on a generatrix in the cylindrical chamber. Advantageously, the position of the injector can be adjusted relative to that of the neck of the combining tube. Likewise, the air for atomisation preferably issues tangentially into the chamber and is supplied from the same source as the combustion air.

The vaporisation chamber connected to the combustion head is advantageously in the shape of a truncated cone which is joined by its small base to the combustion head. The longitudinal axis of the injector then preferably approximately intersects the centre of the wide end of the cone, so as to ensure a more uniform distribution of the jet.

In practice, the vertical distance between the injector and the base of the cone of the vaporisation chamber is greater than the length of resolution of the jet.

Likewise, the walls of the vaporisation chamber will be heated in known manner if necessary, in particular by means of electrical resistances so that these walls are at a temperature 450°-600° C. because the combustible liquid would be condensed below this temperature and cracked above this temperature.

The combustion head is connected at its bottom to the vaporisation chamber and at its top, on its periphery, to the pipe for feeding combustion air. In practice, this combustion air issues in a plane approximately perpendicular to the flow of the fuel vapours and the axis of the head, and the number and shape of the orifices for admitting this combustion air are selected as a function of the results desired. It has been determined that good results are obtained by using a combustion head in the form of a crown, the periphery of which is pierced with orifices for feeding combustion air, and which is surmounted by a cylindrical extension and the base of which possesses, from bottom to top, on the one hand an anti-blow-back grid and on the other hand a flame-holding grid.

In order that the invention may be more clearly understood, the following description is given, merely by way of example, with reference to the accompanying drawings in which.

Figure 3:
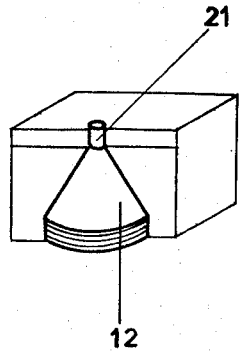
Figure 4:
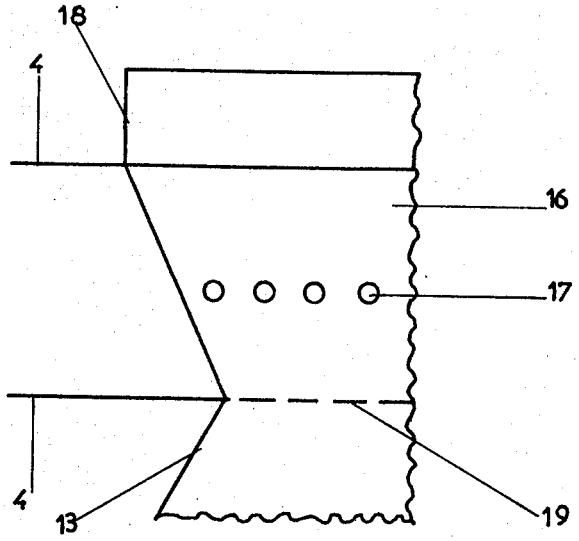
Figure 6:
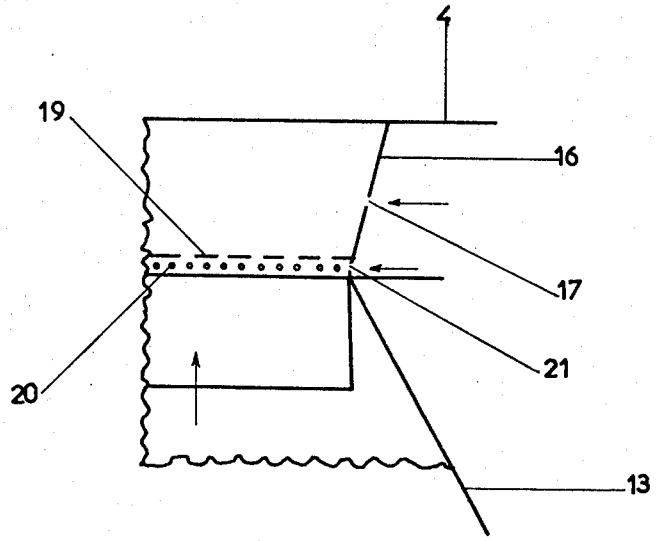

FIG. 3 schematically shows the converging tube;

FIG. 4 and 6 show, in section, a detail of the combustion head; and

Figure 5:
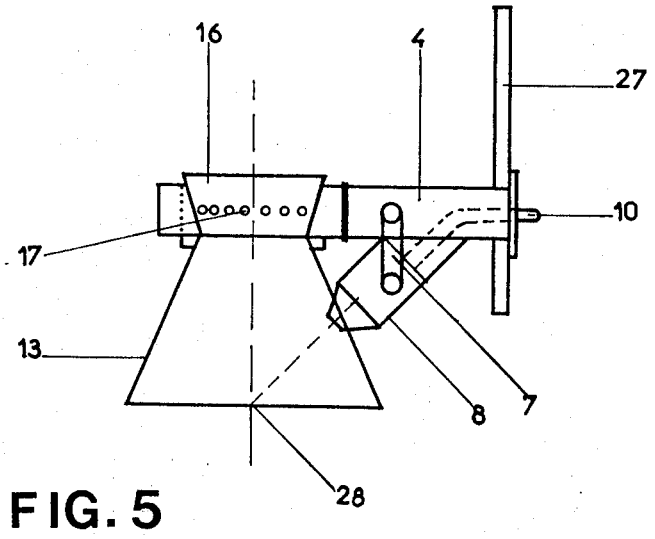

FIG. 5 shows, in a simplified manner, a burner of the invention installed in a boiler.

Figure 1:
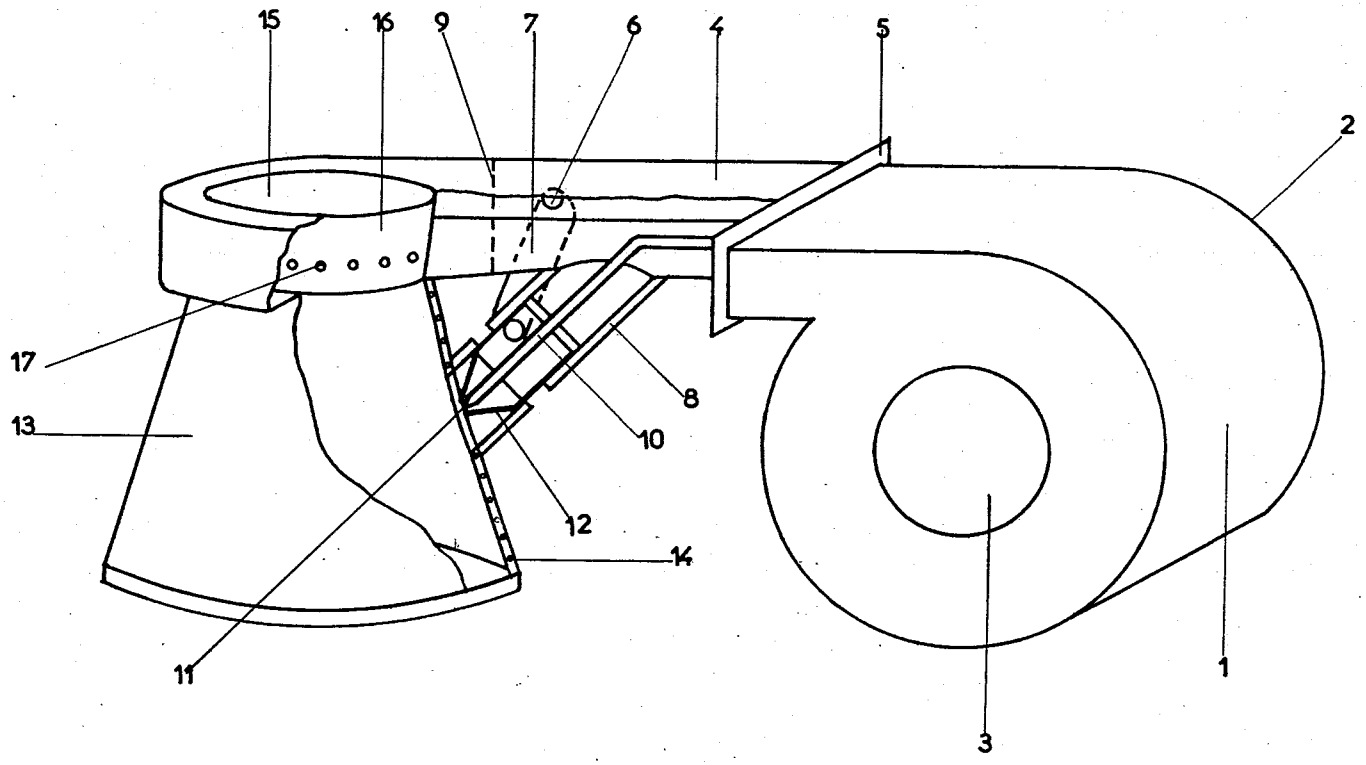
FIG. 1 shows a simplified, partly sectional perspective view of a burner according to the invention.

As shown in FIG. 1, the burner of the invention includes a fan 1 of low power, for example creating three millibars pressure at zero flow-rate. At one side the fan has an electric drive 2, and on its other side an adjustable air intake 3. An air pipe 4, for example made of sheet metal, is joined at its inlet to a mouth 5 of the fan 1, and, at its outlet, to the periphery of a combustion head 15. The pipe 4 is intended to feed a stream of combustion air delivered by the fan 1 to the combustion head 15, where it will combine with vaporised fuel. Connected to the pipe 4 is a side air intake 6 for atomisation air to be passed by means of a pipe 7 into an atomiser 8. A diaphragm 9 controls the volume ratio of the combustion air fed to head 15 to the air for atomisation and it has been found that good results are obtained if such volume ratio is about five. With this ratio, the mixture of air for atomisation and fuel vapours in the atomisation chamber to be described is removed from its limits of flammability.

Figure 2:
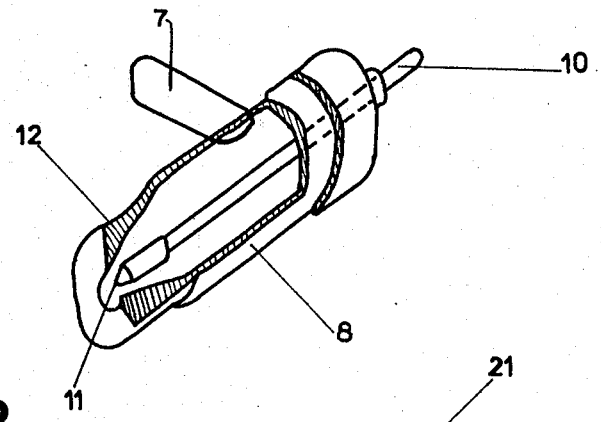
FIG. 2 shows the atomisation device in a simplified partly sectional perspective view.

The burner includes an atomiser particularly shown in FIG. 2 formed by a cylindrical body 8, for example made of brass or steel, into which extends a longitudinal pipe 10 for feeding fuel. The pipe 10 is joined to a source of fuel under pressure, such as a non-compressing pump or a constant level tank. An end 11 of the pipe 10 forms an injector and opens out into a combining tube 12, which is also made of brass or steel, the neck of which is located on a generatrix of a vaporisation chamber 13 which is below the combination head 15. The pipe 7 for feeding the air for atomisation preferably opens tangentially into the body 8. It has been found that good results are obtained if the combining tube 12 has a vertex angle of about seventy degrees and has a cylindrical neck 21 (see FIG. 3), which is preferably one millimeter long. Preferably the distance between the outlet of the atomiser and the inlet of the combining tube is of the order of one millimeter and advantageously 0.5 millimeter; under these conditions, the droplets obtained have a maximum diameter of less than 800 μm and a mean Sauter diameter of 430 μm calculated without taking account of the droplets having a diameter of less than 52 μm.

The vaporisation chamber 13 may be made of sheet metal and has walls which are heated, for example by means of embedded electrical resistances 14, especially when the burner is started.

The combustion head 15 is in the form of a crown, the base which is connected to the upper end of vaporisation chamber 13 and the periphery of which is connected to the channel 4 for feeding the combustion air and is pierced with equiangularly spaced orifices 17. The head 15 (see FIG. 4 and 5 in particular) is advantageously in the shape of a truncated cone, the orifices 17 for feeding the combustion air being distributed uniformly around the wall 16 thereof. The truncated cone is connected to the small end of the vaporisation chamber 13 and is separated therefrom by means of a conventional flame-holding grid 19 of given permeability, which is intended, on the one hand, to hold the flame, and, on the other hand, to control the exit velocity of the fuel vapours. The truncated cone 16 may be surmounted at its large end, by a cylindrical wall 18 extending the outlet of the combustion head 15 (see FIG. 4). In an alternative embodiment without the wall 18 (FIG. 6) the flame-holding grid 19 is associated with and positioned just above a metal gauze sheet 20 which has a greater permeability and is intended to form an anti-blowback grid. The results are then improved by placing, on the crown 16, a second series of equiangularly spaced orifices 21 at the level of the grids 19 and 20.

Conventional components which are not shown, but provided, are a spark igniter using high-voltage electrodes, which is placed at the level of the combustion head, its transformer being intended to provide the energy required for ignition, and flame-monitoring components such as a photoconductive cell for yellow flames or an ionisation probe for blue flames.

For the cases where fuel oil is to be atomised at a flow rate of the order of 0.8 kg per hour, it has been determined that good results are obtained with the following values:

| | |
|---|---|
| ratio of combustion air/air for atomisation | 5 |
| internal diameter of the body 8 of the atomiser | 20 mm |
| length of the body 8 | 50 mm |
| internal diameter of the pipe 7 (which opens tangentially into body 8) | 10 mm |
| combining tube 12, vertex angle | 70° |
| neck 21: length | 1 mm |
| diameter | 6.4 mm |
| injector 11: external diameter | 6 mm |
| diameter of outlet orifice | 0.9 mm |
| distance between orifice 11 and end of the neck 21 | 1.5 ± 0.5 mm |
| flow-rate of air for atomisation | 1.7 to 1.8 $m^3$/hr |
| pressure of air for atomisation | 2.5 to 3 millibars |
| diameter of the orifices 17 | 3 mm |
| diameter of the orifices of the grid 19 | 3 mm |
| permeability of the grid 19 | 30% |
| permeability of the grid 20 | 51% |
| mesh of the grid 20 | 1 mm. |

Under these conditions, a jet is resolved at a mean distance of ten millimeters from the outlet of the atomiser 8. It is possible to check that this jet indeed falls within the range of oscillating conditions and it is determined experimentally that this jet is in the form of a hollow cone having a vertex angle of about ninety degrees, the droplets having a mean diameter of 430 μm.

FIG. 5 schematically represents a burner of the invention which is placed in the lower part of the furnace of a boiler, for example of the "blind furnace" type, which makes it possible to ensure, on the one hand, the circulation of the combustion air before vaporisation, and, on the other hand, additional heating of the vaporisation chamber. In this figure, numeral 27 denotes a furnace support and 28 is the centre of the chamber 13 to which the axis of the jet produced by the atomiser 8 is projected.

The present invention exhibits the advantages that by breaking up the fuel before vaporisation, the speed of vaporisation is increased because the droplets formed have a greater surface area relative to their volume. This makes it possible to reduce the size of the vaporisation chamber and, consequently, to reduce the energy required to heat the chamber to the vaporisation temperature and then keep it at this temperature.

The flame obtained, which is blue or yellow according to the arrangement of the combustion head, develops vertically. By orientating the combustion head and its air inlet differently, and by modifying the upper part of the vaporisation chamber, it is also possible to obtain a horizontal flame.

As already stated, in order to permit atomisation, the delivery pressure of the fan must be of the order of 2½ to 3 millibars, which corresponds to the normal characteristics of the fans currently used for this purpose.

This pressure offers the advantage that it assists the operation of the burners in generators which possess a heat-exchange circuit having fairly high pressure losses. In addition, these burners are easy to construct, adjust and automate. They offer excellent combustion and good efficiency and, finally, they cause little pollution, so that they can be used successfully as burners for domestic heating.

I claim:

1. A burner for use with liquid fuel, said burner comprising in combination a combustion head, means including a pipe to feed combustion air under pressure to said combustion head, a vaporisation chamber connected to said combustion head to provide vaporised fuel to said combustion head, and means for feeding liquid fuel in the form of droplets to said vaporisation chamber, said fuel feeding means including a converging tube terminating in a wall of said vaporisation chamber, means for feeding liquid fuel at essentially atmospheric pressure to said tube and means for feeding a vortical stream of air for atomisation to the level of the neck of said converging tube.

2. A burner as claimed in claim 1, in which said fuel feeding means includes a cylindrical chamber with said converging tube at an end thereof and wherein said means for feeding liquid fuel is on the axis of said chamber and said means for feeding a vortical stream of air opens at a wall of said chamber.

3. A burner as claimed in claim 2, wherein said means for feeding a vortical steam of air opens tangentially into the cylindrical chamber.

4. A burner as claimed in claim 1, wherein said means for feeding air for atomisation is supplied from the same source as said means to feed combustion air.

5. A burner as claimed in claim 1, wherein said vaporisation chamber is in the shape of a truncated cone having a small end connected to said combustion head, the axis of the fuel feeding means approximately intersecting a wide end of the cone at its centre.

6. A burner as claimed in claim 1, wherein said combustion head has a bottom connected to said vaporisation chamber and a periphery connected to the pipe for feeding combustion air, and has air inlets which are generally perpendicular to its axis and thus, in use, to the flow of vaporised fuel.

7. A burner as claimed in claim 6, wherein the combustion head has the shape of a truncated cone, orifices being provided at its periphery for feeding combustion air, and has a narrow end with an anti-blowback grid and a flame-holding grid provided thereat.

8. A burner as claimed in claim 1, wherein said converging tube has a short cylindrical portion at its narrow end which portion terminates in the wall of the vaporisation chamber.

* * * * *